US006201851B1

(12) United States Patent
Piestrup et al.

(10) Patent No.: US 6,201,851 B1
(45) Date of Patent: Mar. 13, 2001

(54) INTERNAL TARGET RADIATOR USING A BETATRON

(75) Inventors: Melvin A. Piestrup, Woodside; Louis W. Lombardo, San Francisco, both of CA (US); Valery V. Kaplin, Tomsk (RU)

(73) Assignee: Adelphi Technology, Inc., Palo Alto, CA (US)

( * ) Notice: Subject to any disclaimer, the term of this patent is extended or adjusted under 35 U.S.C. 154(b) by 0 days.

(21) Appl. No.: 09/148,524

(22) Filed: Sep. 4, 1998

Related U.S. Application Data

(63) Continuation-in-part of application No. 08/872,636, filed on Jun. 10, 1997.

(51) Int. Cl.[7] ..... H01J 35/08
(52) U.S. Cl. ..... 378/121; 378/143
(58) Field of Search ..... 378/119, 121, 378/137, 143; 315/506, 504, 507

(56) References Cited

U.S. PATENT DOCUMENTS 4,845,732 * 7/1989 Michel ..... 378/119
5,247,562 * 9/1993 Steinbach ..... 378/119
5,680,018 * 10/1997 Yamada ..... 315/500

FOREIGN PATENT DOCUMENTS 0 276 437 * 8/1988 (EP) ..... 378/119

OTHER PUBLICATIONS

Piestrup et al., "Quasimonochromatic A–ray Source using Photoabsorption–edge Transition Radiation", Physical Review A, vol. 43, No. 7, Apr., 1991, pp. 3653–3661.*

* cited by examiner

*Primary Examiner*—David P. Porta
(74) *Attorney, Agent, or Firm*—Joseph Smith

(57) ABSTRACT

An apparatus is provided for generating high-intensity x-rays for medical, industrial, and scientific purposes. A thin radiator is placed inside a betatron as an internal target. The radiators are thin enough and the energy of the electron beam is high enough such that the electrons pass through the radiator and return a plurality of times. The average current through the thin radiator is increased by the average number of times the electrons pass through the radiator. Thus, both the average x-ray power and the wall-plug efficiency of the apparatus are increased. In addition, for the betatron the required electron-beam energy is much smaller than that require for recirculation in storage ring and microwave-power cavity acceleration booster rings. This is because the path length around betatron toroid is much shorter; thus, the recycling process is less affected by scattering and energy loss. Since the betatron is technically simple, inexpensive and robust, it is economically and technically superior to prior art synchrotron emitters and internal radiators inside storage and beam stretcher rings.

6 Claims, 10 Drawing Sheets

INTERNAL TARGET RADIATOR USING A BETATRON

CROSS-REFERENCE TO RELATED APPLICATION

This is a continuation-in-part of U.S. patent application Ser. No. 08/872,636 filed Jun. 10, 1997 still pending, by Piestrup, Lombardo, Kaplin, and Skopik, entitled, THIN RADIATORS IN RECYCLED ELECTRON BEAM, which is incorporated herein by reference.

TECHNICAL FIELD

An apparatus is described which uses thin x-ray radiators (e.g. parametric x-ray radiators, transition x-ray radiators, channeling x-ray radiators and resonance transition radiators or combinations of these sources) as internal radiators in betatrons for the production of high intensity, x-rays for medical, industrial, and scientific applications.

BACKGROUND OF THE INVENTION

Synchrotron radiators have been used for over 30 years to produce intense, collimated x rays for scientific and some minor industrial applications. Such applications have been limited since synchrotron radiators are expensive and large, and require large amounts of power to operate and higher electron-beam energies to produce even soft x rays.

In the prior art, transition, parametric and channeling radiators have been proposed as source of collimated radiation, since these sources are less expensive and require lower electron-beam energies. In U.S. Pat. No. 5,077,774, "X-ray Lithography Source" Piestrup, Boyers and Pincus demonstrated that transition radiation can be used as a source of soft x rays for lithography. X rays are produced in a collimated annular cone when relativistic electrons are passed through multiple thin foils. In that patent it was shown that the electron energies greater than 17 MeV could be used to generate soft x-rays in the 800 to 2000 eV range which are ideal for x-ray lithography for the fabrication of integrated circuits. In that patent, electrons are produced from an accelerator and pass once through the transition-radiator foil stack. The electrons are then "dumped" into an appropriate absorber (called a beam dump) where they are no longer used and spurious and harmful radiation is minimized. These radiators could be excellent sources of x rays provided high enough electron-beam current could be sent through them. However, given the modest currents available from Linear Accelerators (LINAC's), Roger Carr has shown that in most cases periodic-medium radiators driven by such conventional LINACs are not practical (Roger Carr, Nuc. Instrum. Meth. vol. 347, p. 510 (1994). As pointed out by M. A. Piestrup, D. G. Boyers, C. I. Pincus, J. L. Harris, X. K. Maruyama, H. S. Caplan, R. M. Silzer, D. M. Skopik, "Beryllium-foil transition radiation source for x-ray lithography," Appl. Phys. Lett. vol. 59, pp. 189–191, 1991., to make transition radiation a competitive source of soft x rays for lithography, one needs to increase the x-ray flux to power levels of 10 mW/cm$^2$ at the mask-wafer surfaces. This is a factor of one tenth of what was observed in that cited patent.

The cost of a LINAC ($1m to $5m) to drive a parametric x-ray (PXR) source would make a radiographic system prohibitively expensive when compared to conventional imaging systems (price range of mammography systems: $75K to $150K). Because of its narrow bandwidth and directionality, PXR could provide a substantial improvement in image quality over that of a conventional system; however, the higher cost would be difficult to justified.

In the prior art, Betatrons have been long known as relatively inexpensive sources of electrons and hard x-ray emission when compared to LINACs and storage rings. The betatron is technically a simple device, robust and easy to fabricate when compared to LINACs. The principle of betatron acceleration is based on Faraday's Law: an alternating magnetic field is surrounded by a rotational electric field. Electrons can be accelerated by this electric field, while at the same time being guided by the magnetic field. The process involves injecting low-energy electrons into an evacuated toroid and then increasing the fields that "link" the toroid. As the magnetic fields rise, the electrons are accelerated by the induced electric field and the process is allowed to continue until the electrons acquire the desired kinetic energy. The first betatrons were successfully designed and operated by Kerst in the 1940's (D. W. Kerst and R Serber, Phys. Rev. 60, 53 (1941)).

Once the electrons reach the desired energy, they can be driven into a stationary tungsten target placed within the betatron toroid, thereby producing bremsstrahlung x-rays. These internal bremsstrahlung radiators have been used since the beginning of betatron development. In general, these have been thick tungsten radiators for the production of very hard x-rays. The electron beam is stopped or drastically scattered so that only one pass of the electrons is achieved.

Betatrons were in use throughout the 1960's and early 1970's for the purpose of cancer therapy. Manufacturers included Allis-Chalmers, Varian Associates and Brown-Boveri. The betatron accelerator has many advantages for generating high-energy electron beams compared with other acceleration techniques. At energies below 35 MeV, betatrons have a much simpler construction than either linear induction or RF LINACs, and as such are inherently more reliable. Moreover, the output beam energy can be easily varied by either changing the maximum induction field in a given acceleration cycle, or keeping the maximum induction field fixed, varying the time at which the beam is driven into the target. Unlike LINACs, increasing the betatron's beam current does not cause the output energy to fall. On the other hand, the standard iron-core betatron is current-limited compared with the LINACs of similar size and energy. Space-charge effects limit the amount of charge captured per acceleration cycle (D. W. Kerst, Phys. Rev. 60, 47 (1941)). When this is coupled with a low frequency of operation (which is limited by ferromagnetic core loss), time averaged currents of only a few tenths of a $\mu$A are achieved. Today, there is no commercial viability for such a dim source and, currently, only Russian Betatrons are being constructed.

In a German patent #0-276-437 by inventors Wolfgang Knupfer, Manfred Pfeller, and Max Huber it was proposed, but not tested, that crystals be precisely aligned in electron storage rings to produce x-ray by the channeling of the electrons (or positrons) through the planes of the crystal. Transition, parametric, bremstrahlung radiators are not mentioned. In one embodiment, a storage ring has its electrons supplied by a microtron and a small RF accelerator structure in the storage ring is utilized to supply lost energy to the recycling electrons. The issue of the necessity of how to maintain the electron beam in the storage ring was not discussed. Indeed, no correct estimates on the number of passes through the radiator were given. A claim of achieving beam times "on the order of an hour" are not possible with internal solid radiator placed inside of the ring. As was shown in the parent application (Piestrup, Lombardo, Kaplin, and Skopik, "Thin Radiators in Recycled Electron Beam" in U.S. patent application Ser. No. 08/872,636 filed Jun. 10, 1997), total beamtime is limited to a few microseconds in accelerators of even high energy, 800 MeV.

The German patent does not state how the electron beam is to be injected into the storage ring using the microtron. In all schemes for storage rings and synchrotrons the microtron or LINAC can only inject for one pass of the electron beam. The method of injecting the beam into the ring requires an electrostatic field or magnetic field by a "kicker" magnet to inject the electrons. Returning electrons that meet this field after one pass will be ejected out of the ring. In all synchrotron and storage rings, the kicker magnet is turned off after one pass of the beam and the beam is allowed to "dampen" into a stable orbit which is smaller than the injection orbit. Note that this would also limit the length of the injected electron beam pulse and, hence, for small rings such as the one proposed in the German patent, this effectively severely limits the average current.

In the parent application of this case, it was suggested and demonstrated that storage rings can be utilized to increase the average current through other thin solid radiators (besides channeling crystals). The thin radiator thickness is chosen to be small enough such that the electrons pass through, yet thick enough so that sufficient x rays are produced. Thus, the radiators can seen to be quasi-transparent to electrons. In these schemes a thin radiator is placed in the storage ring, synchrotrons or cyclical accelerator where the electron beam passes through the thin radiator many times. Thus the average current through the radiator is dramatically increased. Since the x-ray production through the thin radiator is directly proportional to the electron current or the number of electrons passing through the radiator, the x-ray flux increases proportionally to the average current and the overall efficiency of the radiator. As in the case of synchrotron radiators, such storage rings are very expensive and the amount of x-ray flux is lower than that achieved by using the ring for the generation of synchrotron emission. Unlike the German patent cyclical accelerators are also proposed in the parent patent application as one method of achieving multiple passes through the radiator.

In a proof of principal experiment of the parent application by Piestrup et al., electrons are injected into the storage ring at the rate at which the accelerator is being pulsed. The pulse length is short enough that the electrons only make one pass around the ring during the injection pulse. Thus, there is no problem of the electrons seeing the electrostatic field of the injector. This limits the length of the pulse and requires that large rings be used.

Prior to the parent application by Piestrup et al., it was assumed that even a thin solid target inside a storage ring would result in sufficient scattering and energy loss that the electrons would only make one pass through the target. However, subsequent analysis and experiments show that recirculated electron beams can achieve multiple passes through radiators that have sufficient thickness for efficient x-ray emission. In the proof of principal experiment carried out at the Saskatchewan Accelerator Laboratory (SAL), radiators were thin 0.18 to 9 $\mu$m and the electrons were of sufficient energy 118 to 252 MeV so that the electrons passed through the radiators many times. A variety of single and multiple foil transition radiators made of different foils were utilized (C, Al, Cu and Ta). Passes of between 5 and 385 passes were observed depending upon the electron-beam energy and the radiator thickness and density. In this energy range (118 to 252 MeV) and radiator thicknesses, the Al radiators showed the number of passes were proportional to the radiator thickness. Thus the measured power from the single-foil transition radiator was the same as the measured power from the 9-foil transition radiator.

In the proof of principal experiment carried out at the Tomsk Sirius storage ring for the parent application, both parametric and transition radiators were utilized. A thin radiator of 48 $\mu$m Silicon was placed in the storage ring and 20 passes were measured for a 800 MeV electron beam. Photon energy of 20 keV was generated from this crystal. Note for this ordinary storage ring, the number of passes is small. Thus, it was not at all obvious from the German patent, that enough passes could be achieved using the microtron driven storage ring scheme that was briefly discussed therein. Indeed, the German patent makes no references to the number of passes that could be obtained.

These proof-of-principal experiments were also presented for high energy electron beams (E>800 MeV) in M. Yu. Andreyashkin, V. V. Kaplin, M. A. Piestrup, S. R. Uglov, V. N. Zabaev, "Increased X-ray Production by Multiple Passes of Electrons trough Periodic and Crystalline Targets Mounted Inside a Synchrotron," Appl. Phys. Letts. 72 pp. 1385–1387 (1998) and at moderate energy electron beams (E>118 MeV) M. A. Piestrup, L. W. Lombardo, J. T. Cremer, G. A. Retzlaff, R. M. Silzer, D. M. Skopik and V. V. Kaplin, "Increased x-ray production efficiency from transition radiators utilizing a multiple-pass electron beam" The Review of Scientific Instruments 69, No. 6, pp. 2223–2229(1998).

In the parent application, the number of passes was small especially when the electron beam energy was at it lowest (measured at 118 MeV). This was most likely due to the long path length for one trip around the storage ring and the finite aperture of the beam pipe and various magnet gaps around the ring. The latter were limited in size to maximize the magnetic field. These small aperture diameters, d, functioned with the long electron path length, L, to form a large aspect ratio (L/d). Thus if the electrons deviated from their path through the ring, they easily collided with the walls of the beam pipe of the magnet gaps. It might be possible to design a storage ring with a smaller aspect ratio; however, this would be expensive and require larger magnets and beam pipe.

SUMMARY OF THE INVENTION

In accordance with preferred embodiments of the invention, an intense x-ray source is provided which uses a betatron with an internal thin x-ray target. The thin target radiator is mounted inside the betatron annulus and located such that at the end of the acceleration cycle of the betatron the electron beam strikes the thin radiator. In a preferred embodiment, the electron beam can be recycled through the thin x-ray target during each acceleration cycle of the betatron. In that embodiment, the radiator is thin enough so that the electrons pass through the radiator a plurality of times, and in the preferred mode many times. Thus, the average electron current though the radiator is dramatically increased while the wall-plug input power to the betatron remains the same and the overall efficiency of x-ray power conversion from wall-plug power is increased. Since a thin radiator is being used, there is little absorption of the x-rays in the radiator after they have been produced. Depending on the thin radiator material and thickness, the number of orbits that an electron will achieve has been determined. The average current through the radiator increases roughly as the product of the initial current times the number of passes through the radiator. Since the average current determines the amount of x-rays generated by radiation, one can achieve a much brighter x-ray source than that produced by a single pass of the electron beam through the radiator. In the preferred embodiments, several thin targets are described which can include a transition radiator (single foil or multiple foil), a parametric x-radiator (crystals such as Si <111> or graphite <002>, channeling radiator (crystals), and multiple crystals in periodic array.

The combination of the betatron and thin radiator will cost less to purchase and less to operate than LINAC driven radiators, storage rings with internal radiators and synchrotron radiators. This system can be viewed as a hybrid device using a recycled beam (as in the case of the synchrotron) to excite a thin radiator. Thus the wall-plug efficiency is increased by the number of passes through the media. Estimates of 10 to 1000 passes through the radiator result in a corresponding increase in wall-plug efficiency and increase in photon flux.

In comparing the betatron-driven thin radiator with that of a rotating anode (bremsstrahlung source), one must keep in mind that these thin x-ray sources, utilizing relativistic beams, produce an emission that is radiated out into a narrow beam, diverging roughly as $1/\gamma$ (for 18 MeV this is less than 2°); whereas, a rotating anode tube is approximately radiated into all angles ($4\pi$ steradians). Thus although the rotating anode tube has efficiencies of 1 to 3%, only a small percent of these x-rays is useful for imaging. For example, the photon efficiency at 33.5 keV for a rotating anode tube is $4\times10^{-6}$ photons/electron-str in a 3% bandwidth, while that of a PXR source is $10^{-4}$ photons/electron-str into similar bandwidth. Wall-plug efficiencies for the betatron have been calculated to be 2.5 to 5% from wall plug to electron beam power. The overall efficiency of the betatron-radiator is further increased by recycling the electron beam through the crystal (10 to 1000 passes).

In accordance with preferred embodiments of the invention, using computer simulations it has been shown that thin radiators can be used inside the betatron to produce appreciable amounts of x rays for lithography (when a transition radiator is used inside the betatron) and medical imaging (when a parametric radiator is used inside the betatron). Most importantly, the electron energy required to drive these thin radiators is smaller than that needed to drive thin radiators inside of storage rings. This was an unexpected result. Indeed, it was expected that larger energies were needed; however, since the electron path inside the betatron toroid is shorter than that of the electron path inside of most storage rings, the effects of scattering and energy loss are not as destructive to the process of recycling the electron beam through the radiator. In other words, the aspect ratio (L/d) of the electron path length, L, to the toroid aperture, d, is small for the betatron and large for most storage rings. Thus scattering and energy loss from the electrons passing through the internal radiator does not easily deflect the electrons into the toroid wall of the betatron. Since scattering is inversely proportional to the square root of the electron beam energy, the internal-radiator betatron can utilize lower electron energy and cost less than that of the internal-radiator storage ring.

Furthermore, this invention provides a solution to the problem of the high cost of a radiographic system by utilizing a thin x-ray source. For example, the use of the compact betatron would reduce the cost of the radiographic systems for mammography. We have estimated that the cost of fabricated materials for an 18 MeV betatron including power supply would be $78K in quantity and $167K for a prototype. This is close in cost to conventional x-ray-tube-driven mammography systems, and yet provides much enhanced x-ray beam characteristics.

As another benefit, the betatron/parametric-x-ray radiator of the invention can also be much smaller than that of a synchrotron emitter. That is because these emitters require a much lower electron-beam energy than does a synchrotron emitter or a storage ring with an internal radiator. Kaplan et. al. have shown that parametric x-radiators can generate hard x-rays using only 6-MeV electrons (V. V. Kaplan, M. Moran, Yu. L. Pivovarov, E. I. Rozum, S. R. Uglov, Nuc. Instrum. Meth. B 122, 625 (1997). This is below the neutron generation range, reducing problems of background radiation and permitting the use of a compact betatron that is comparable in size to a conventional x-ray tube with its related cooling system and power supply.

Another important advantage of the internal target in a betatron is that the electron beam does not have to be extracted from the betatron in order to strike the radiator. Thus it does not need expensive electron-extraction techniques: no extra magnets, beamless or electrostatic deflectors.

DESCRIPTION OF PREFERRED EMBODIMENTS

Figure 1:
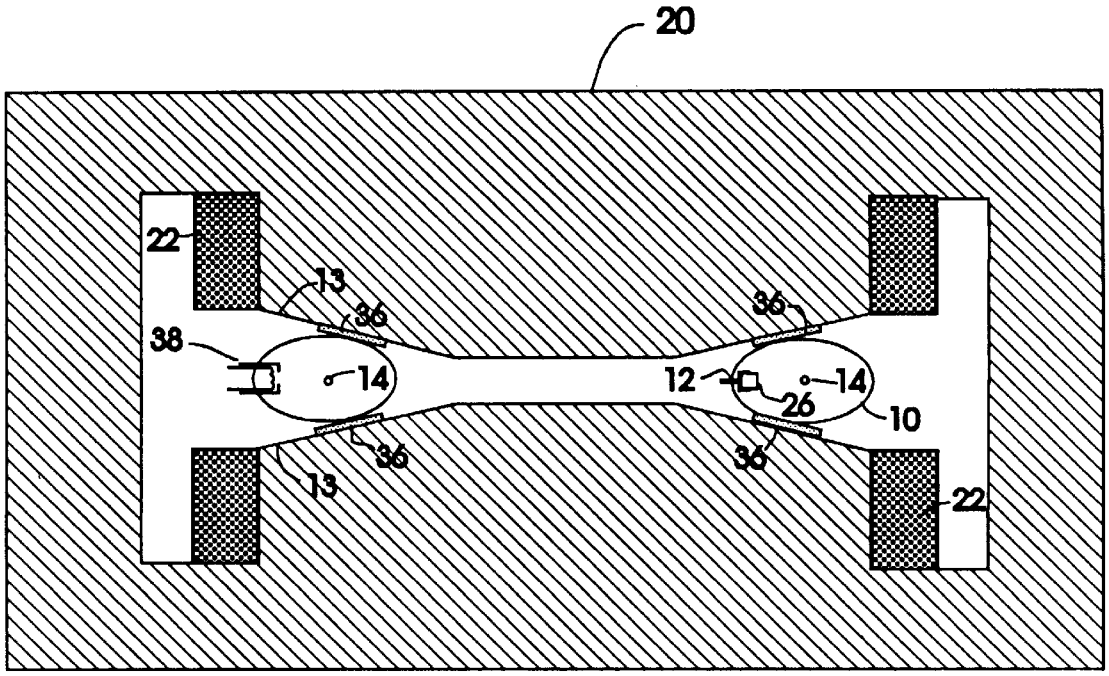
FIG. 1 shows a compact betatron having an internal radiator and the orbiting electrons.

As illustrated in the following preferred embodiments, the device is made up of a betatron with an internal thin x-ray radiator. As examples, the internal radiator can be a transition radiator, a channeling radiator, a parametric radiator, a bremsstrahlung radiator or a radiator that combines two or more of these effects. These radiators are generally defined as radiators that generate x-rays when a relativistic electron beam, whose velocity is close to the velocity of light, passes through the radiator. FIG. 1 shows a cross-section of one side of a betatron with an internal radiator 26. In this embodiment, the betatron is a unit housed in a single case which comprises a vacuum chamber toroid 10 disposed within the pole tips 13 of the magnet core 14. The magnet consists of the magnetic core 14 and coils 22. The pole tips 13 and the coils 36 of the betatron are shown in relation to the toroid wall 10. In this embodiment, the thin radiator 26 is placed inside (inboard of) the stable orbit 14. Expansion/contraction coils 36 are provided as a means of adjusting the electron orbits during the initial phase of electron injection. The expansion/contraction coils 36 are also used during the final phase to direct the electrons into the thin target.

Figure 2:
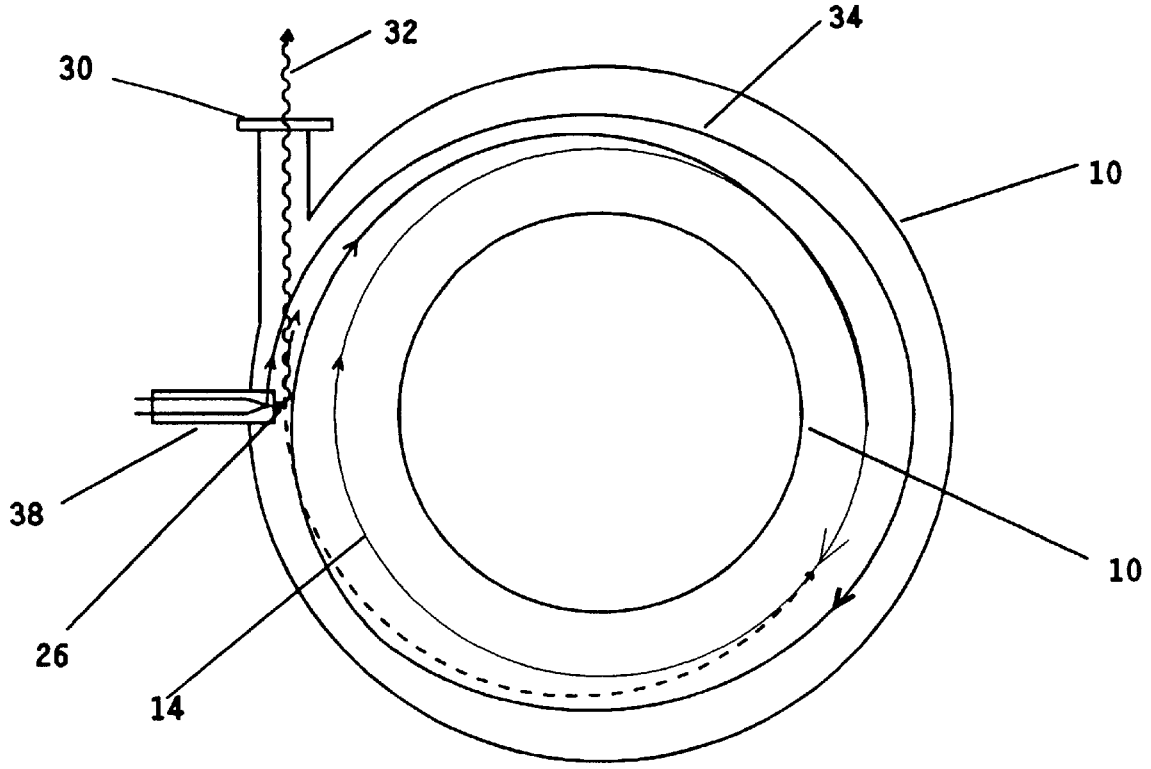
FIG. 2 shows a top view of betatron toroid vacuum chamber illustrating the thin radiator position and electron trajectory.

In another embodiment, the thin radiator 26 is placed outside (outboard of) the electron beam stable orbit. FIG. 2 shows this arrangement from a top cross-sectional view of the acceleration vacuum chamber toroid 10. In this embodiment, the radiator 26 is placed on the electron gun 38 anode. This simple arrangement is used to place the radiator 26 inside the vacuum chamber 10 while minimizing the number of ports into the chamber. This arrangement eliminates the need for a separate vacuum port for the radiator.

For either of the above two embodiments, the radiator 26 is thin enough that the electrons pass though it with minimal scattering and energy loss. Since the electron orbits are only slightly perturbed, the electrons can complete more revolutions and then pass through the thin radiator 26 again. As the electrons repeatedly pass through the radiator, they emit x-rays by processes know as transition, bremsstrahlung, parametric, and channeling radiation (or combinations thereof) depending upon the radiator installed in the betatron. The preferred embodiments all rely on the fact that the electron beam is relativistic. The half angle divergence of the x-rays from these sources varies roughly as $E_o/E$ where E is the electron beam energy in MeV and $E_o$ is the electrons rest energy of 0.511 MeV. For a 35 MeV electron beam, the half angle divergence is only 14 mrads; hence, the radiation is highly collimated compared to x-rays generated by a conventional x-ray tube.

The collimated radiation will exit through an x-ray window 30 that is thin such that x-ray absorption in the window is minimized. The window must be thick enough to support the pressure differential between the outside and the inside of the vacuum chamber 10. Depending on the electron energy and the thin radiator thickness, the electrons can recycle through the radiator many times before their orbits become unstable and they collide with the wall of the vacuum chamber. The most important effect of this process is that the average electron current through the radiator 26 is dramatically increased, proportionate to the number of passes through the radiator 26. Since this current determines the amount of x-ray generated by the radiator, we can expect a great increase in the average brightness of the thin radiator 26. Under the proper conditions, the increase can be greater than a factor of 1000.

OPERATION OF THE INVENTION a. Description of Operation

The principle of the betatron is based on Faraday's Law: an alternating magnetic field is surrounded by a rotating electric field. Electrons are accelerated by this electric field, while at the same time being guided by the magnetic field. In order for the electrons to remain on a stable orbit, the betatron condition must be satisfied. Simply stated, the betatron condition requires that the averaged field enclosed by the electron orbit (i.e. the "core" field) be twice the averaged field at the orbit (i.e. the "guide" field). For the electron orbit to remain fixed within the vacuum chamber, this proportionality of the fields must be maintained throughout the acceleration process.

As illustrated in FIG. 2, at the beginning of the acceleration cycle, the electrons are injected from an electron gun 38 into the vacuum chamber toroid 10. As in prior art betatrons, electrons are injected by a thermal emitting cathode at the outer perimeter of the vacuum chamber. The electrons then travel in roughly circular trajectories 34 under the influence of the guide field. The fields are temporarily modified during injection so that a useful fraction of the injected electrons miss the electron gun during subsequent orbits. As stated above, a stationary orbit requires that the ratio of the guide and core fields be held constant. By changing the ratio, the orbits can be made to expand or contract. In particular, the electron orbits will contract if the magnitude of the guild field is increased relative to the core field. Physically, this is equivalent to supplying a bending force greater than required to keep the electron in its present orbit. As a result, the electron begins to spiral inward, toward the core and away from the gun. The necessary increase in the guide field (relative to the core field) can be accomplished by exciting the expansion/contraction coil with a transient current pulse.

Following injection, the electrons are accelerated as the core and guide fields are increased. As the electrons approach their final energy, their orbits approach the stable orbit known as the equilibrium orbit 14. The electron orbits can then be expanded outward by again violating the betatron condition using the expansion/contraction coil. As a result, the electron trajectories 15 intersect the thin radiator 26. For radiators located on the inside of the equilibrium orbit (inboard radiator), the energy loss per pass will help move the electron trajectory deeper into the radiator. For an outboard radiator, the energy loss tends to mitigate the influence of the expansion/contraction coil and a larger transient coil current is used ensure that the beam continues to transfix the radiator.

b. Simulation of a Internal Target Inside a Betatron

To demonstrate that electrons can be recirculated in the betatron toroid through the thin radiator, a computer simulation was utilized. For each candidate radiator, all of the salient beam-radiator interactions were calculated, including electron scattering, energy loss and x-ray generation efficiency. These parameters determine the number of passes that an electron beam can achieve and the maximum flux achievable. Two simulations are required to achieve this. One determines the number of passes, while the other determines the x-ray flux generated from the radiator.

The number of passes that an electron can be expected to make through a radiator will be limited for two reasons. First the scattering that occurs will increase the amplitude of the betatron oscillations and eventually cause the electron to collide with the toroid walls. Second, the energy loss of the electron passing through the foils will cause a reduction in the electron orbit radius. These effects will be different depending upon the radiator material and thickness, and the position of the internal radiator which can be located at the inner or outer radius of the betatron annulus.

Figure 3:
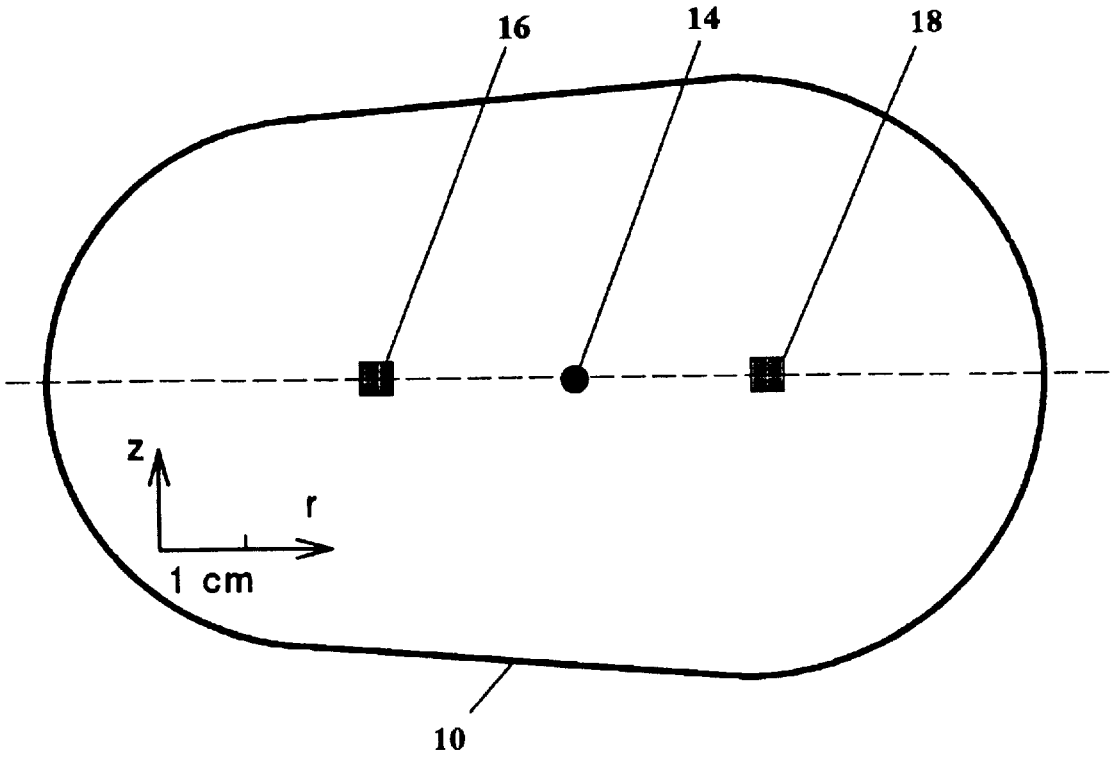
FIG. 3 shows cross-sections of the 35 MeV betatron chamber according to the invention.

The cross section of a 35 MeV betatron toroid chamber is shown in FIG. 3. The recycling effect was simulated for the case of two possible inside (inboard) 16 or outside (outboard) 18 positions of the targets with respect to the equilibrium orbit 14. The equilibrium orbit 14 is at 24.5 cm. The simulation includes several sizes for the transition radiator. The recycling effect was simulated for both square and vertical strip transition radiators having sizes of 4×4 $mm^2$ and 1×16 $mm^2$, and placed at various inboard and outboard positions. If one neglects energy loss, the uncorrelated scattering from successive passes will add in quadrature giving a total spread of $\sqrt{n}<\theta_s^2>^{1/2}/2$ mrads where n is the number of passes and, $<\theta_s^2>^{1/2}$ is the rms scattering angle. The spread which can be accommodated by the toroid is estimated from the amplitude of the sinusoidal betatron oscillations. For example, 25-MeV electrons passing through a 25 $\mu$pm-graphite crystal has a rms half angle of about 1.4 mrad (see V. L. Highland, Nucl. Instrum. Methods vol. 129, p. 497 (1975) for calculation of rms scattering). The 25-MeV betatron required to deliver this beam would have a 18-cm equilibrium orbit, a field index of 0.75, and a 1-cm toroid minor radius; the maximum allowable beam spread (half angle) is 28 mrads. Using the above expression relating the total spread to the number of passes, one finds that 400 passes should occur before the betatron oscillations reach the toroid wall. This very rough estimate indicates that scattering for thin graphite crystal permits a large number of passes.

Energy loss for most materials due to ionizations is approximately 2 MeV/gm/$cm^2$. For the above example, the average energy loss experienced by the electron is ~10 keV per pass for the 25-$\mu$m graphite crystal. This is an appreciable energy loss which exceeds the average amount gained per pass. If the radiator is inboard, the orbit radius continues to shrink with each pass of the electron through the radiator. For relativistic electrons, the orbit radius is proportional to the electron's energy. If the radiator is outboard, then the electron radius is also reduced, but the electron is now back in an accelerating field in which it can regain the lost energy.

For a thinner radiator (less than the above example), the scattering is minimal and, thus, the number of orbits will be not governed by either scattering or energy loss, but will we limited by the total number of orbits permitted by the acceleration cycle. Using 2% of the betatron period and orbit period of 3 ns, this would give approximately 3000 passes.

Alternatively, an inboard radiator could be used and then the energy loss merely serves to push the electron trajectory deeper into the radiator. For relativistic electrons, the rate at which the orbit contracts is proportional to the rate of energy loss. For 25 MeV electrons losing 300 eV per pass and an equilibrium radius of 18 cm, the orbit contraction is 2 $\mu$m per pass. If the radiator has a width of 2 mm, 1000 passes will occur before the electron orbit contracts beyond the radiator. For the case of the 25 $\mu$m graphite crystal, the loss would be 10 keV per pass, and the amount of contraction would be 72 $\mu$m per pass and 28 passes would be permitted. These simple estimates have been verified by a computer simulation which we developed.

An analysis of the circulating dynamics of 18 and 35 MeV electron in various size vacuum toroids with transition and parametric radiators of differing targets sizes, thicknesses, and positions were performed to determine the operational parameters of the preferred embodiments. The spatial and angular distributions of the electron trajectories were studied as the electrons made multiple passes both through the thin PXR and transition radiation (TR) targets. The spatial and angular distributions of the x-rays produced were then calculated using previously developed theory. The angular broadening effects of scattering and electron-beam divergence are dependent upon the electrons' incoming energy. Angular trajectories of the electrons as they emerge from the crystal were calculated accurately by assuming that the angular distribution was Gaussian. The spectral distribution of the PXR is obtained by convolving the well-documented spectral-angular distribution with a Gaussian distribution of electron deflection angles (see I. D. Feranchuk and A. V. Ivashin. J.Physique vol. 46. p.1981. 1985).

The simulations were based on the magnetic field parameters and toroid sizes of commercially available betatrons manufactured by the Research Institute of Introscopy (RII) in Tomsk Russia. The simulations permitted observation of the decay of the electron beam intensity as the electrons made repeated passes through the radiators. The mean number of electron-target passes was calculated as a function of the target's thickness, size and position within the betatron chamber.

The computer program simulated the orbits of the electrons inside the betatron, where they were allowed to traverse thin crystal radiators. As the electrons passed through the crystal, they suffered elastic scattering and energy loss. Thus their orbits are altered, and, after a number of passes, they strike the walls of the glass toroid or the electron gun. The simulation utilizes a "focusing potential" formulation of the betatron's magnetic field. The value of the potential function is altered after each pass of the electrons through the crystal. A Monte-Carlo method was used to model the effects of electron scattering and energy loss in the crystal. The resulting electron velocity and orientation were then used to revise the focusing potential. This was done by solving the Lorentz force equations for the electron trajectory in cylindrical coordinates with the potential function of the betatron magnetic field V(r,z) applied to the two second order differential equations for electron radial and axial positions as a function of azimuthal angle. A system of differential equations was solved numerically using a FORTRAN implementation of the Runge-Kutta method. In the calculations, the electron beam was described as a set of electrons with up to 5000 different initial coordinates and velocities. At the beginning of the simulation, the orbiting electron beam has just been dumped onto the target's edge by the controlled action of an additional magnetic field. Scattering within the target modifies both the velocity and orientation of the electron. These modifications are then used to calculate the new potential function V(r,z) appropriate for the scattered electron. The new position, orientation, and potential are then used as the initial conditions, and the electron is allowed to complete enough orbits (up to several hundred) until it again strikes the target, the toroid walls or the injector.

Completing this first set of orbits for all electrons in the beam, the simulation provided the ratio $n_1$ of the number of electrons that reached the target a second time to the number of electrons that originally left the target. Also noted were the spatial and angular distributions of the electrons as they reached the target the second time. Then, the second stage of the simulation was begun by again scattering the electrons, generating the new initial conditions and potential functions, and orbiting until the next collision with the target, toroid, or injector. The value $n_2$ and the second stage spatial and angular distributions were then noted and the process continued.

In more concrete terms, the basis of the numerical simulation was the "focusing potential" formulation of the betatron's magnetic field. The following set of equations, expressed in cylindrical coordinates (r, θ, z), prescribe the trajectory of the electrons in the guide field of the betatron:

$$\frac{m}{e}\ddot{r} = -\frac{\partial V}{\partial r}, \quad \frac{m}{e}\ddot{z} = -\frac{\partial V}{\partial z}, \quad \sqrt{\frac{m}{e}}\,\dot{\theta} = \sqrt{\frac{2V}{r}} \tag{1}$$

or, after elimination of the time coordinate t, $$\frac{d^2r}{d^2\theta} = \frac{r^2}{2V}\left[-\frac{\partial V}{\partial r} - \frac{1}{r}\frac{dV}{d\theta}\frac{dr}{d\theta} + \frac{2V}{r^3}\left(\frac{dr}{d\theta}\right)^2\right], \quad \frac{d^2z}{d^2\theta} = \frac{r^2}{2V}\left[-\frac{\partial V}{\partial z} - \frac{1}{r}\frac{dV}{d\theta}\frac{dz}{d\theta} + \frac{2V}{r^3}\frac{dr}{d\theta}\frac{\partial z}{d\theta}\right], \tag{2}$$

where V(r,z) is the potential function associated with the focusing forces of the betatron's magnetic field, $m=m_o\gamma$, $m_o$ and e are the rest electron mass and charge, $\gamma$ is the relativistic factor. As the electrons enter the target, the following mass-velocity relation was taken into account:

$$v^2 = (r\dot{\theta})^2 + \dot{r}^2 + \dot{z}^2 = \frac{2Ve}{m}\left[1 + \left(\frac{1}{r}\frac{dr}{d\theta}\right)^2 + \left(\frac{1}{z}\frac{dz}{d\theta}\right)^2\right] = \frac{2Ve}{m}[1 + \tan^2\theta_r] \tag{3}$$

where $\theta_r$ is the angle of electron trajectory measured with respect to the equilibrium orbit. This geometric relation permits us to adjust the value of V(r,z) based on the scattering that occurs as the electron traverses the target. The potential appropriate for the new electron trajectory is given by:

$$V_2 = V_1\frac{m_2}{m_1}\frac{(1-(m_0/m_2)^2)}{(1-(m_0/m_1)^2)}\frac{(1+\tan^2\theta_1)}{(1+\tan^2\theta_2)}, \tag{4}$$

where the subscripts 1 and 2 correspond to the values before and after the target respectively. After the k-th pass, the potential has the form determined by the equation:

$$V_k = V_1\frac{m_k}{m_1}\frac{(1-(m_0/m_k)^2)}{(1-(m_0/m_1)^2)}\prod_{j=1}^{k}\frac{(1+\tan^2\theta_{j-1})}{(1+\tan^2\theta_j)},$$

The system of differential equations (eqns. 2) was solved numerically using a FORTRAN implementation of the Runge-Kutta method. In the calculations, the electron beam was described as a set of electrons with up to 5000 different initial coordinates and velocities. At the beginning of the simulation, the orbiting electron beam has just been dumped onto the target's edge by the controlled action of an additional magnetic field. Scattering within the target modifies both the velocity and orientation of the electron. These modifications are then used to calculate the new potential function V(r,z) appropriate for the scattered electron. The new position, orientation, and potential are then used as the initial conditions and the electron is allowed to complete enough orbits (up to several hundred) until it again strikes the target, the toroid walls or the injector.

Completing this first set of orbits, for all electrons in the beam, we obtained the ratio $n_1$ of the number of electrons that reached the target a second time to the number of electrons that originally left the target. Also obtained was the spatial and angular distributions of the electrons as they reached the target the second time.

The second stage of the simulation was commenced by again scattering the electrons, generating the new initial conditions and potential functions, and orbiting until the next collision with the target, toroid, or injector. The value $n_2$ and the second stage spatial and angular distributions were then noted and the process continued.

Approximately 10–20 stages were calculated for each crystal. For, example, in the case of 6 MeV betatron it was necessary to calculate only a few stages. But, for 35 MeV betatron, we calculated 20 stages. At last, by using the Picar method of a step-by-step approximations, converging according to (eqns. 2) in our case, the dynamics of electrons was calculated in the range of k>10–20 and obtained the function N(k) describing the process of "decay" of recycling beam. The fraction N(k) of the electron beam remaining after k passes through the target was determined according to the formula:

$$N(k) = N_k = \prod_{j=1}^{k} n_j$$

This approach is optimum for calculating the large k passes because of large electron energy losses for multiple passes of the electrons through the radiators. Thus, rather than using a Monte Carlo simulation for calculating the beam dynamics at large k, the mean energy loss and angular distribution of the electrons was calculated using the standard Molier theory for each pass of the electrons through the radiator. Using these simplifications, each pass of the electrons through the target is calculated as a single act in the simulation process.

c. Simulation of Parametric X-ray Emission from an Internal Crystal.

Figure 4:
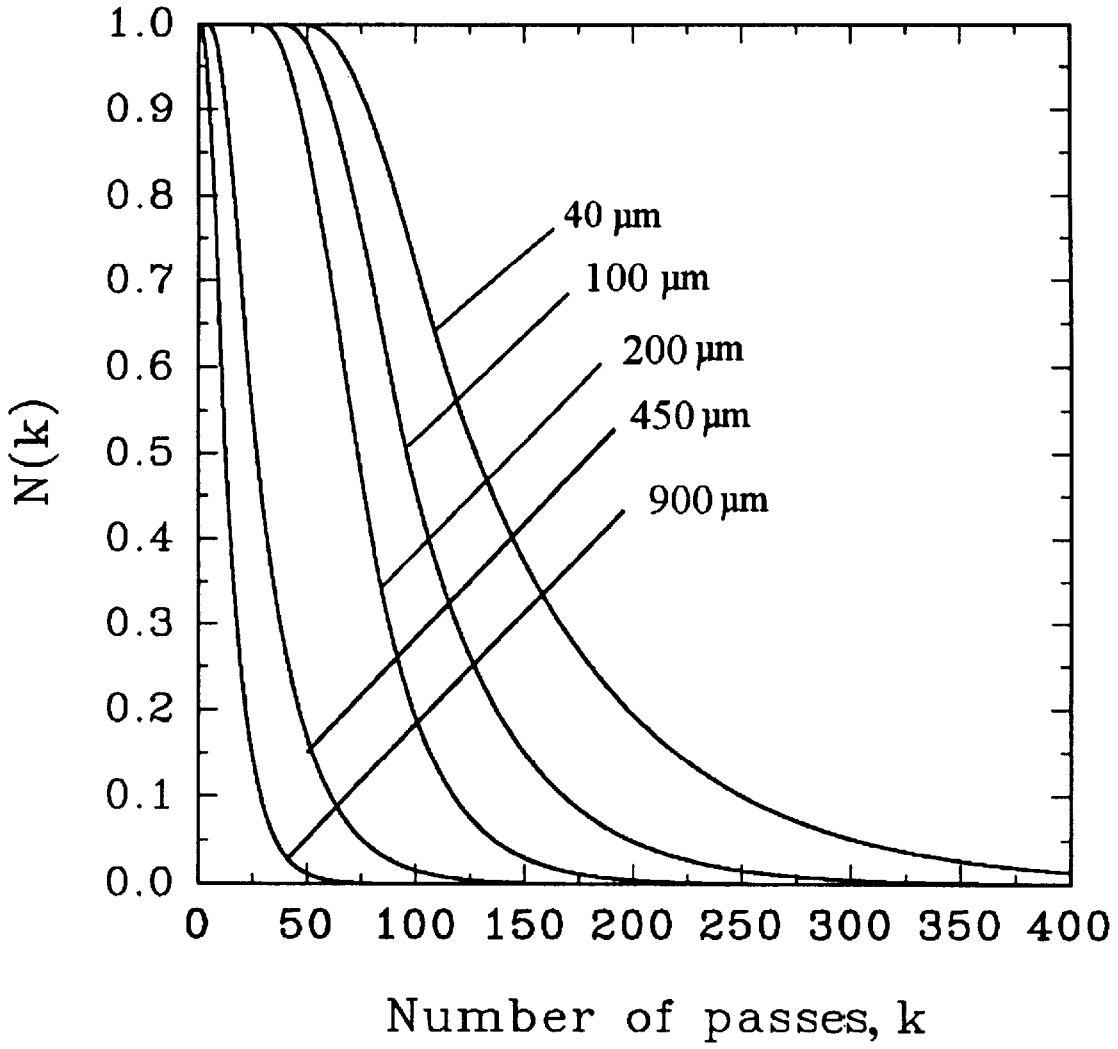
FIG. 4 shows the calculated fraction N(k) of the electron beam remaining after k passes through the graphite for Si radiator thicknesses of 40, 100, 200, 450. 900 $\mu$m. The mean number of recirculations, $k_e$, are 149, 107, 78, 32 and 15. Targets are placed at the optimum radial position in the toroid of 11 cm. Electron energy is 18 MeV.

The geometry chosen for the parametric radiator was a narrow vertical crystal of 1 mm width that could be placed at various radial positions. As shown in FIG. 3, the radiator can be in two different positions relative to the stable electron beam orbit: in-board position 16 and the outboard position 18. The fraction N(k) of the electron beam remaining after k passes through the crystal was calculated. N(k) was determined for various crystal positions: both in-board and out-board. The data indicated that the greatest electron longevity was realized when the target was positioned at $R_t$=11 cm. This target position is closest to the equilibrium orbit, being just inside of it. FIG. 4 shows the fraction N(k) of the electron beam remaining after k passes for various radiator thicknesses with the crystal positioned at 11 cm from the center of the toroid. The mean numbers of electron-target passes through 40, 100, 200, 450, 900 $\mu$m Si targets are approximately $k_e$=149, 107, 78, 32 and 15, respectively. The electron beam energy was 18 MeV.

The high values found for the mean number of passes, $k_e$, indicates that beam recycling can be used to dramatically increase the efficiency of electron-beam-based radiative processes. This is particularly true for processes involving small formation or absorption lengths. Using the simulation results for the recycled electron beam, the spectral and angular characteristics of parametric x rays (PXR) generated by a beam recycled through thin Si crystals has been calculated. This simulation was performed for a recycled 18 MeV beam of the betatron.

For the calculation of the PXR characteristics, the Feranchuk-Ivashin theory was used(see I. D. Feranchuk and A. V. Ivashin. J.Physique vol. 46. p.1981. 1985). A special computer program for the numerical calculation accounted for: (1) the spatial and angular distributions of the electrons striking the crystal, (2) multiple scattering of electrons in the crystal, and (3) the shape of X-ray detector collimator.

Figure 5:
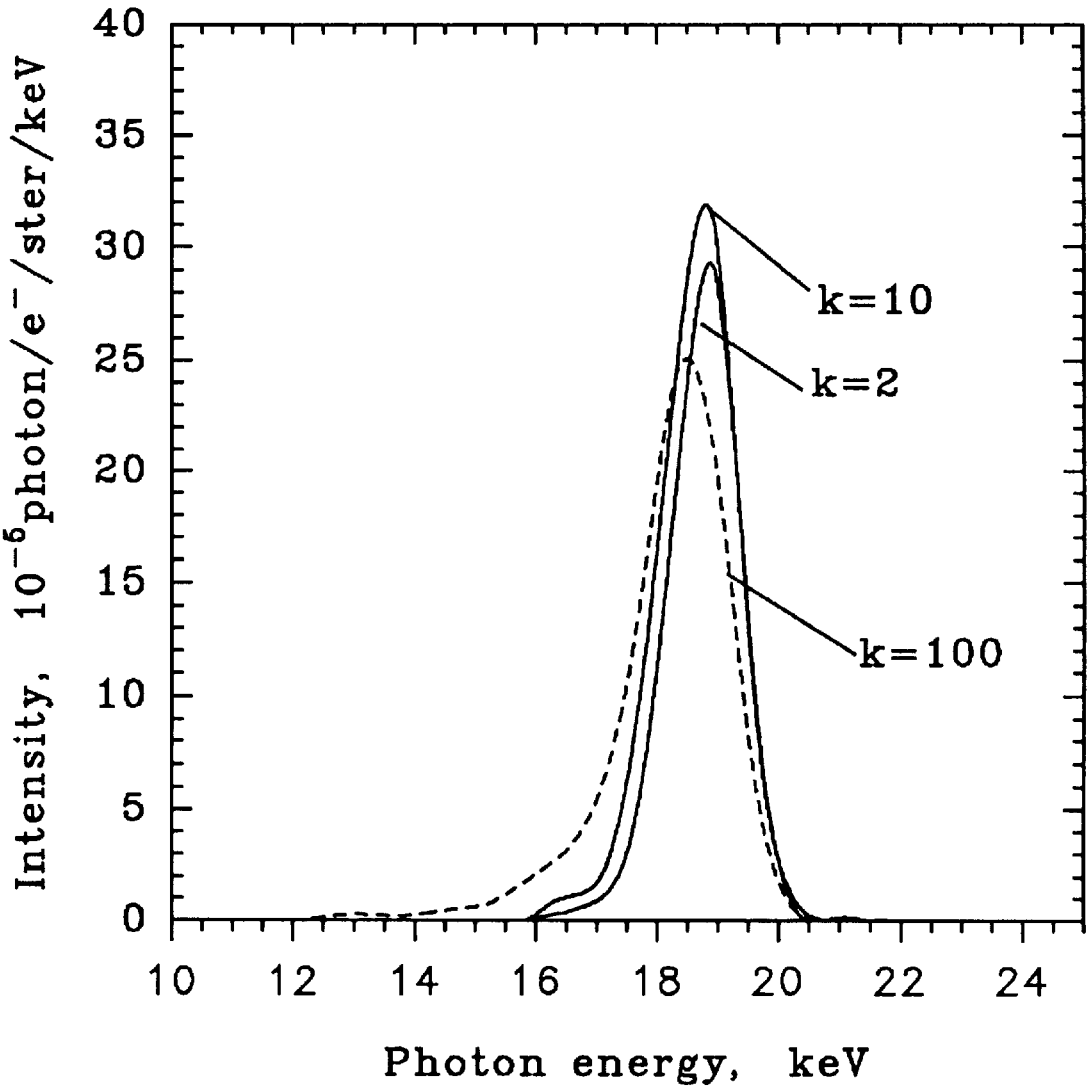
FIG. 5 shows the calculated intensity variation as a function of angle for the number of passes, k=2, 10 and 100. The crystal is 100-$\mu$m-thick pyrolytic graphite.

FIG. 5 presents the spectra of collimated PXR produced by the 2nd, 10th and 100th passes through the crystal. These spectra were obtained for a narrow vertical slit collimator of 4×4 mrad which was placed at the Bragg position with respect to the electron beam. It is seen that recycling does not substantially spoil the bandwidth or general shape of the spectral line, so that the emission intensity is proportional to the mean number of electron passes, $k_e$, through the crystal. For high quality medical imaging it was demonstrated that a source of approximately 10% would give a higher quality image.

Figure 6:
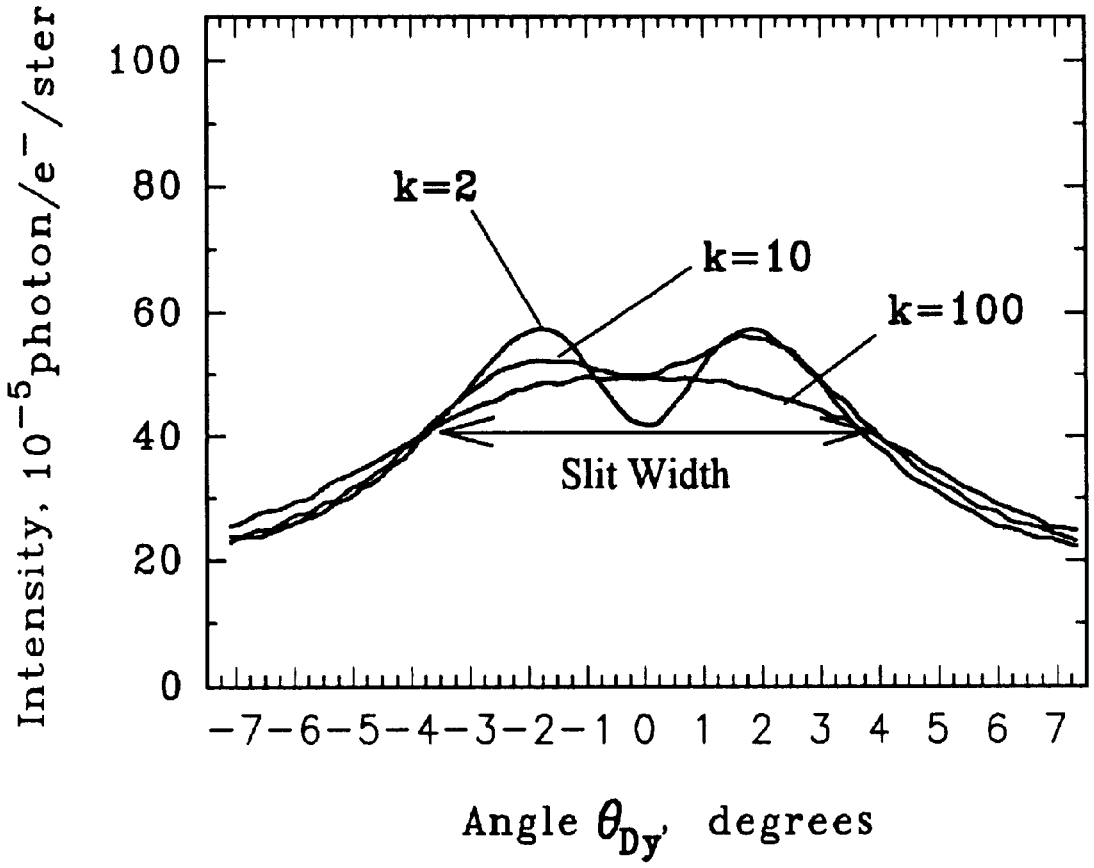
FIG. 6 shows the calculated absolute differential production efficiency of PXR produced at the 2nd, 10th, and 100th pass of 18 MeV electron through a 100-$\mu$m-thick graphite crystal.

For medical imaging, spatial uniformity of the x rays is also important for achieving optimum exposure and image quality. FIG. 6 shows the result of the simulation of the x-ray spatial distribution PXR produced by the 2nd, 10th and 100th passes through the crystal. The slit width in the non-dispersive direction is shown. As can be seen from FIG. 6, for higher number of passes the x-ray distribution is smoothed out. This permits a more uniform exposure and thus is a positive effect of electron scattering which is increasing with additional passes.

d. Simulation of Transition X-ray Emission from a Beryllium Foil Stack.

Figure 7:
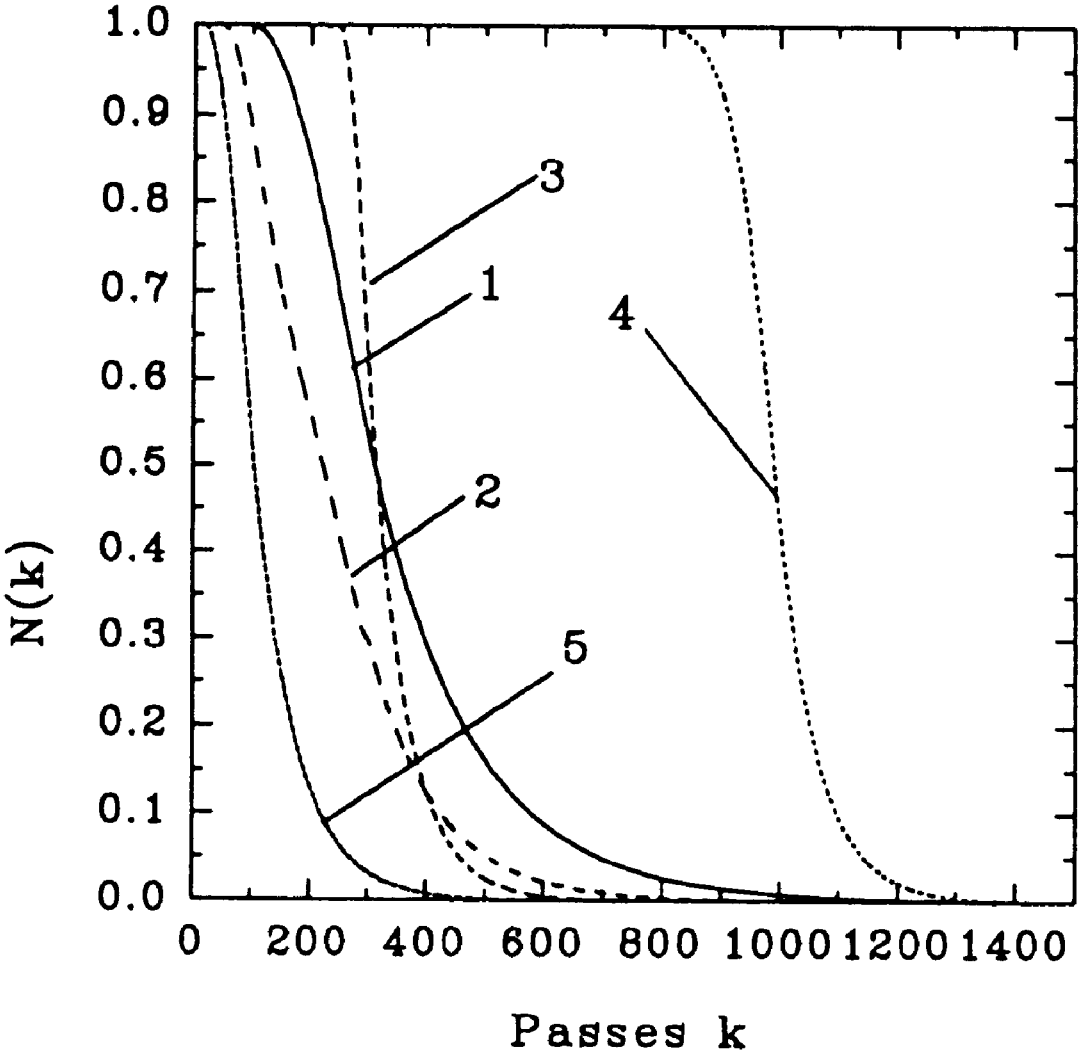
FIG. 7 shows the calculated fraction N(k) of the electron beam remaining after k passes through different thin Be foils of various thicknesses, positions and foil areas.

To simulate transition radiation, the best radiator for soft x-ray emission was used: a Be foil stack. From that simulation, FIG. 7 plots the fraction of the number of electrons left after the k'th pass as a function of k passes for different targets placed inside (inboard 16) or outside (outboard 18) the stable beam orbit. Curves 1–4 are for the target positions $R_t$=22.25 cm. Curve 1 is for 10 foils of 1.1-$\mu$m-thick Be with area measuring 1×16 mm$^2$. Curve 2 is for 30 foils of 1.1-$\mu$m-thick Be with area of 1×16 mm$^2$. Curve 3 is for 30 foils of 1.1-$\mu$m-thick Be with a surface area of 4×4 mm$^2$. Curve 4 is for 10 foils of 1.1-$\mu$m thick-Be with a surface area of 4×4 mm$^2$. Curve 5 presents the case of outside target position $R_t$=26.4 cm, 10 foils of 1.1-$\mu$m thick Be with a surface area of 1×16 mm$^2$. For these embodiments, one can see that the inboard position and square target is the best to achieve the largest number of passes. This is highly dependent on the selection of the betatron and its magnetic field configuration. This embodiment is for a RII betatron constructed in Tomsk Russia.

Figure 8:
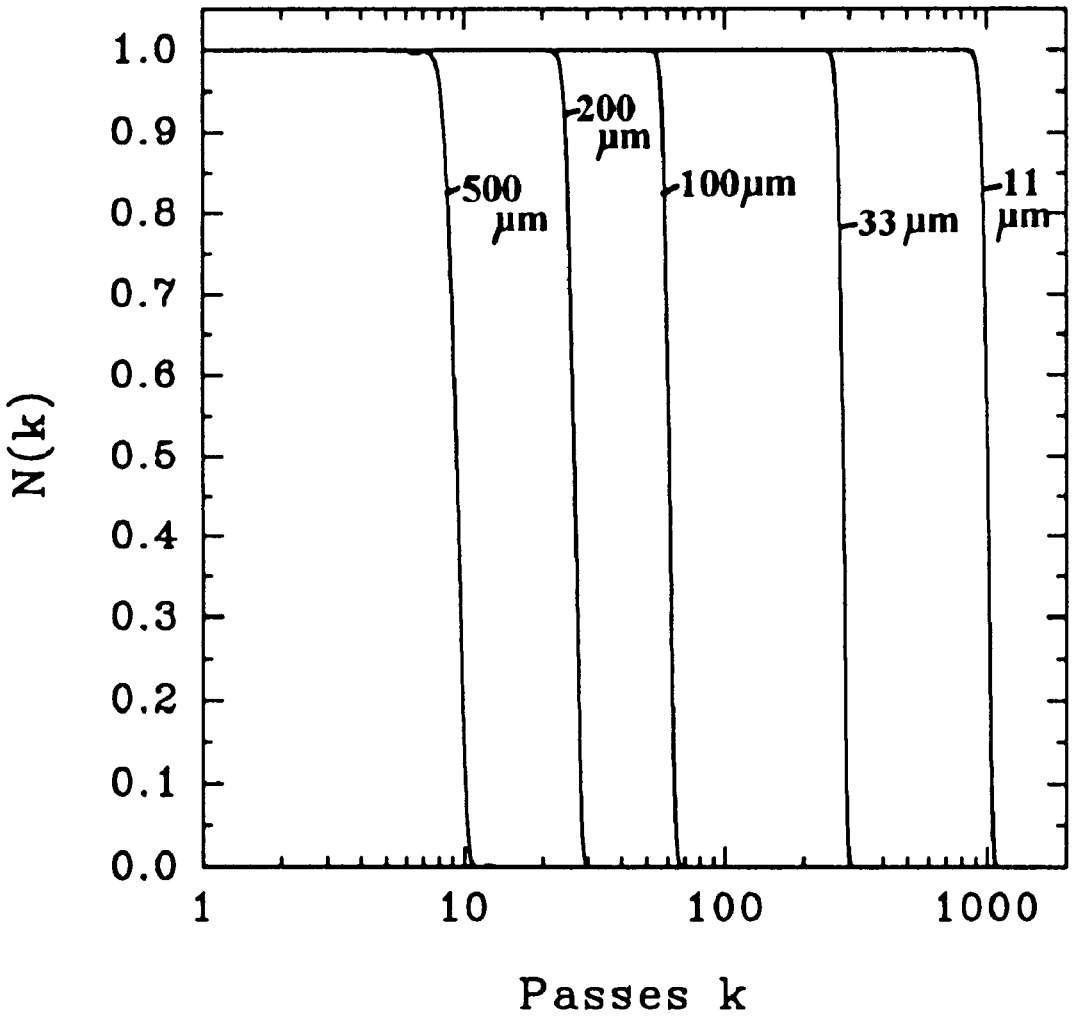
FIG. 8 shows the calculated fraction N(k) of the electron beam remaining after k passes through 11, 33, 100, 200 and 500 $\mu$m thick Be targets placed at $R_t$=22.25 cm.

At the optimum position of $R_t$=22.25 cm, as plotted in FIG. 8, on sees the fraction of the number of electrons left after the k'th pass as a function of k passes for the 4×4 mm$^2$ square Be foils with total thicknesses (number of foils x single foil thickness) of 11, 33, 100, 200 and 500 $\mu$m curves 1–5, respectively. The mean number of electron passes for the cases presented in FIG. 8, curves 1–5, the calculated values of $k_e$=994, 325, 60, 26, and 9, respectively. The high values found for the mean number of passes, $k_e$, indicate that beam recycling can be used to dramatically increase the efficiency of electron-beam-based radiative processes.

For the calculation of the transition radiation's spectral and spatial characteristics a well-known method was used as described in M. A. Piestrup, J. O. Kephart, H. Park, R. K. Klein, R. H. Pantell, P. J. Ebert, M. J. Moran, B. A. Dahling, and B. L. Berman, "Measurement of transition radiation from medium-energy electrons," Phys. Rev. A vol. 32, pp. 917–927, August 1985. The computer program for the numerical calculation accounted for: (1) the spatial and angular distributions of the electrons striking the multifoil target, (2) multiple scattering of electrons in the target, and (3) the shape of X-ray detector collimator.

Figure 9:
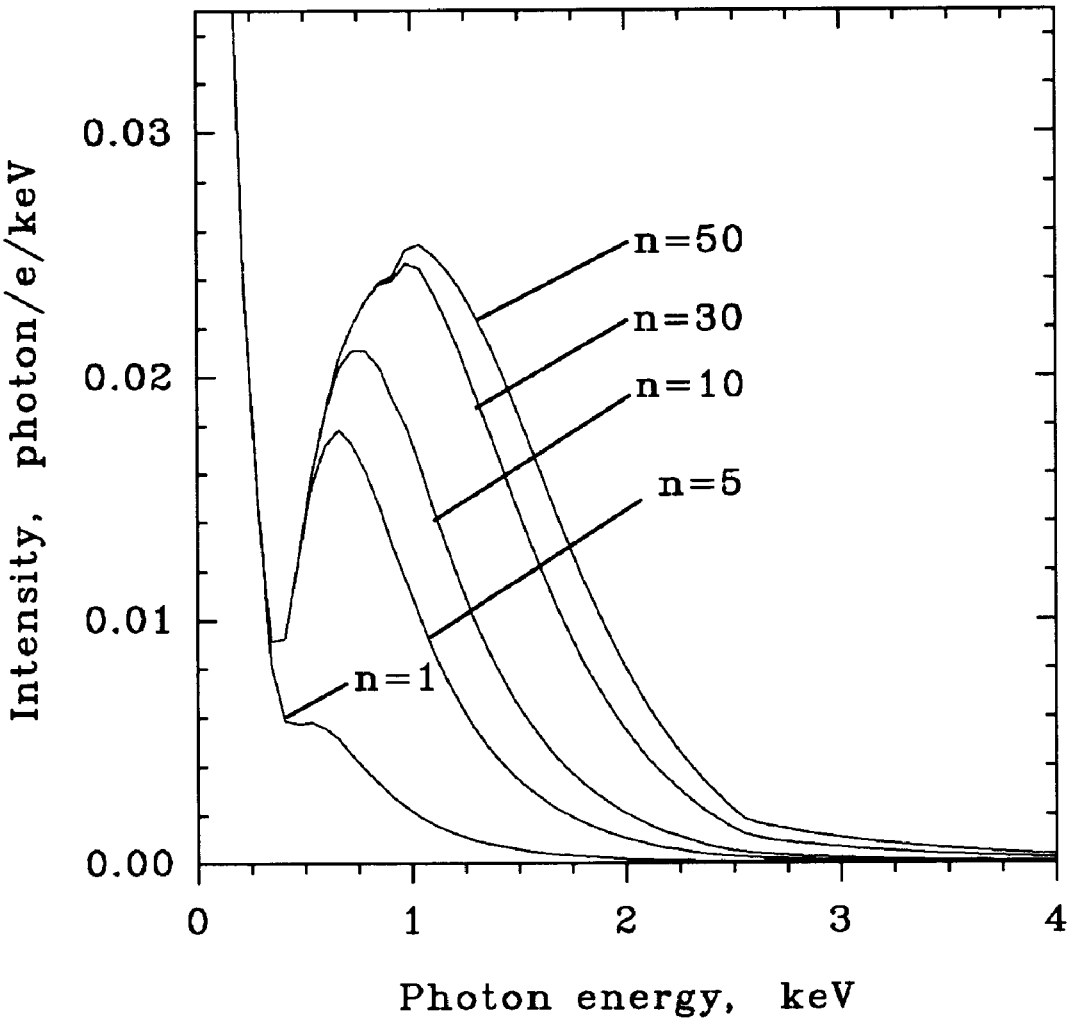
FIG. 9 shows the spectra of transition radiation generated by 35-MeV electrons in radiators consisted of 1, 5, 10, 30 and 50 Be foils, each 1.1-$\mu$m thick.

The spectra of TR generated by a single 35 MeV electrons in the 1, 5, 10, 30 and 50 Be foil target are shown in FIG. 9. This spectrum is ideal for the x-ray lithography for the production of integrated circuits. The Be radiator consist of the 1.1 $\mu$m foils. The x-ray spatial distribution is the ring with angular radius of about $1/\gamma$. To check how scattering and energy loss affected the spatial distribution of the x rays, the horizontal and vertical distributions of transition radiation was calculated, generated at the 4th, 200th and 300th passes of 35 MeV electrons in the 30 Be foil target. As one can see in FIGS. 10A and 10B, the TR distribution loses specific circular form at passes having large enough numbers. The vertical and horizontal profiles of TR distribution are noticeable changed, but not significantly as to spoil such TR characteristic as directionality.

Figure 10A:
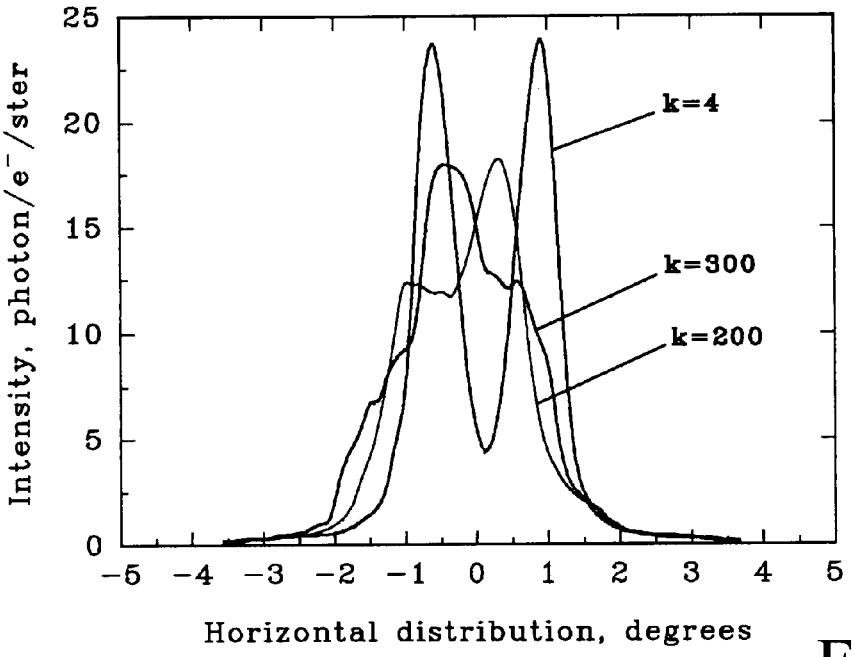
FIG. 10A shows the horizontal profiles of the angular distributions of 0.2–5 keV TR generated by 35-MeV electrons in the 30-foil target at k=4,200, and 300 passes.
Figure 10B:
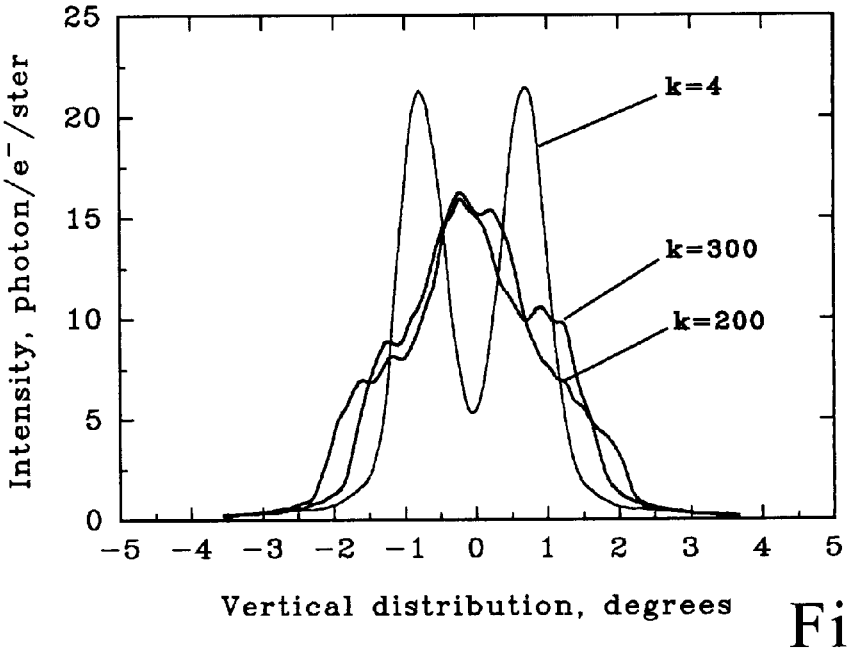
FIG. 10B shows the vertical profiles of the angular distributions of 0.2–5 keV TR generated by 35-MeV electrons in the 30 foil target at k=4,200, and 300 passes.

The angular density of TR generated by recycled electrons in the 30 foil target can be estimated from FIGS. 10A and 10B as $k_e$×15 photons/electron/ster=4875 photons/electron/ster. The spectrum of TR from recycled electron can be obtained by means of simple multiplication of the spectrum for single electrons on the mean number $k_e$ of passes.

The most important effect of recycling process is that the average current through the internal target is increased very effectively. This is a very promising method for increasing the efficiency of soft X-ray sources on the base of TR. In principle, there is no problem to create a betatron having a current of about 10 $\mu$A. In this case, it is possible to obtain an electron current of about 3.25 mA through the 30 foil above-mentioned TR radiator. Our estimation shows that the flux of generated x rays can reach the value of about 10 mW/cm$^2$ on the distance of 100 cm from the target.

The decaying electrons will ultimately strike the betatron toroid walls and generate unwanted background radiation which will be distributed isotropicaly around the betatron. To reduce this spurious x-ray emission we propose to utilize a "scraper" placed on the opposite side of the betatron toroid. The scraper is a high density electron absorber. The electrons, which are leaving the recycling regime, will strike the scraper rather than the toroid wall. In this case, the background radiation will be emitted mainly in opposite direction with respect to the useful x-ray beam.

Our computer simulation of electron dynamics in a 35-MeV betatron chamber with an internal transition radiator has led us to the following conclusions:

1. Even for moderate electron beam energies (18 and 35 MeV), the mean number of electron passes depends on the internal radiator thickness and can reach a 100 to 1000 passes for foil thicknesses which are necessary for the increased production of soft X-rays for x-ray lithography.
2. The efficiency of recycling strongly depends on the target geometry and position inside a betatron chamber. The mean number of passes is greater for the square targets positioned just inside the equilibrium orbit.
3. The recycling effect does not substantially degrade the directionality and spectral characteristics of TR generated by 35-MeV betatron electrons. The total yield and spectral density of TR increase proportionally to the mean number of the electron recirculations through an internal target.
4. Beam recirculation can substantially increase the efficiency for using electron-beam power for soft-x-ray production. The average current of the electrons through internal target can be greater than that of modern linear accelerators.

e. Radiator Design for an Internal Target Radiator

The radiator thickness is designed such that the maximum x-ray flux is obtained. This is determined by the number of passes that the electrons take through the radiator, the absorption of the x-rays in the radiator medium, the efficiency of the radiator (photons/electron) and radiator heating. Efficiency is usually determined by a trade off between the thickness of the radiator and the absorption of the x-rays in the generating medium. This is true for both parametric and transition radiators. The number of passes through the thin radiator is determined by thickness the radiator composition, density, energy of the electrons, position of the radiator in the toroid, and the geometry of the vacuum toroid.

In this invention, thin radiators are defined as radiators that are thin enough such that the radiation generated in the radiator is not appreciably absorbed in the generating medium, and the elastic and inelastic scatterings are small enough that recycling of the electrons occurs, and preferrably a high level of recycling. Absorption of the x-ray in the radiator material will be small if the thickness of the radiator, l, (in direction of x-ray emission) is less than $1/\mu$, where $\mu$ is the absorption coefficient of the radiator material in units of 1/length (the absorption coefficient is defined at the desired x-ray photon energy being generated). Thus $l<1/\mu$. However, to further determine the optimum radiator length one must include the effects of elastic and inelastic scatterings. The design of the radiator with a particular betatron will depend upon the desired application of the radiation which, in turn, depends upon the desired x-ray intensity and x-ray photon energies desired. There are three general regimes to be aware of in these design:

(1) Very thin radiator where absorption in the radiator medium is small and very high energy electrons are utilized. As was demonstrated in the parent application, the total x-ray output was proportional to the product of the number of foils time the number of passes (N×k) for the case of transition radiation and to the product of the crystal thickness times the number of passes. Thus, in this regime, the total power was constant and independent of the number of foils. Stated another way, absorption of x rays in the generating medium is small and where the electrons are very relativistic, the number of passes is inversely proportional to the number foils; thus, in this range of energies and very thin radiators, the photon emission is a constant as the thickness of the PXR radiator is varied or the number of foils is varied. Thus, for this case, as the number of foils increases, the number of passes drops proportionally. However, the maximum number of passes will be limited by the heating of the foils by the electron beam current which is proportional to the number of passes through the radiator. Thus in this regime, one must make sure that the radiator must be thick enough to limit the number of passes so that heating does not destroy the radiator. In the parent application, a transition radiator of one to 9 foils of 1 $\mu$m Al were used in the energy range of 118 to 252 MeV. In this range, the total power was independent of the number of foils.

(2) Very thin radiators where absorption in the radiator medium is small and moderate energy electron are utilized. As was demonstrated in FIG. 8, when the energy of the electron beam is lowered, the number of passes drops dramatically and the total power emitted is no longer a constant for increasing number or number of foils or radiator thickness. For the case of the 35-MeV electron beam and a transition radiator, the maximum flux was given by the thinnest radiator (11 $\mu$m). Again, as in case 1, the maximum number of passes will be limited by heating of the foils by the average electron beam current. As the average number of passes goes up, so does the average current through the radiator. Again in this regime, one must again make sure that the radiator must be thick enough to limit the number of passes so that heating does not destroy the radiator.

(3) Thin radiators where absorption in the medium is appreciable and moderate energy electrons are utilized. In this range of parameters, the thickness of the radiator is limited by absorption. For example, a Be foil stack designed to produce 1 keV x-ray photons would be limited to about 33 $\mu$ms (or 30 foils of 1.1 $\mu$m Be). At this point the radiator thickness is $l\approx 1/\mu$. To achieve maximum x-ray emission one wishes to maximize the number of passes through the radiator. One can do this by increasing the electron beam energy to the regime where the number of passes is inversely proportional the radiator thickness or to where the maximum number of passes is limited only by foil heating.

In one embodiment for soft x-ray production for lithography, we would utilize an inexpensive and reasonable size 35 MeV betatron. As stated before, 35 MeV is the top energy for a reasonable size and inexpensive betatron. Since we are limited in energy (case #3), we would take a Be foil stack that is absorption limited. Thus the radiator of 30 foils of 1.1 Be whose area is 4×4 $mm^2$ would be placed in the toroid at a 22.25 cm radius. The maximum number of passes is now limited by foil heating. An electron beam of 10 $\mu$A would give soft x-ray radiation whose power was approximately 10 $mW/cm^2$. Rotation of the foils would be required for cooling. Such a source would produce an x ray spectrum shown in FIG. 9.

What is claimed is:

1. Apparatus for generating high-intensity x-rays comprising:

an electron beam source comprising a betatron having a toroidal ring for generating an electron beam;

an x-ray source comprising a thin radiator for generating x-rays from said electron beam;

wherein said thin radiator is placed inside said betatron toroidal ring such that the path of said electron beam intersects said thin radiator.

2. Apparatus as in claim 1, wherein said thin radiator is designed to be thin enough such that individual electrons in said electron beam penetrate and pass through said thin radiator a plurality of times while orbiting inside said betatron toroidal ring.

3. Apparatus as in claim 1, wherein said thin radiator comprises a thin crystal oriented such that the electron beam direction and the exit port or slits relative to the crystal planes are at the Bragg condition either in the Bragg geometry or the Laue geometry; and x-ray emission known as parametric x-ray emission is generated.

4. An apparatus as in claim 1 where the target comprises a crystal oriented such that the electron-beam direction is along one axis of the crystal and that the said electron-beam is captured and channeled along the said crystal axis; and x-ray emission known as channeling radiation is generated.

5. Apparatus as in claim 1, wherein the target comprises a foil stack composed of series of thin foils such the electron beam penetrates and passes through said foils generating x-ray emission known as transition radiation.

6. Apparatus as in claim 1, wherein said thin radiator is selected from the group consisting of a channeling radiator, a parametric radiator, a transition radiator, a resonance transition radiator, or a combination thereof.

* * * * *